US007025217B2

(12) United States Patent
Crown et al.

(10) Patent No.: US 7,025,217 B2
(45) Date of Patent: Apr. 11, 2006

(54) DISPLAY ASSEMBLY

(75) Inventors: Peter Crown, Loughborough (GB); Stephen Prosho, Loughborough (GB)

(73) Assignee: Artform International Ltd., Loughborough (GB)

( * ) Notice: Subject to any disclaimer, the term of this patent is extended or adjusted under 35 U.S.C. 154(b) by 0 days.

(21) Appl. No.: 10/297,456

(22) PCT Filed: Jun. 5, 2001

(86) PCT No.: PCT/GB01/02463

§ 371 (c)(1),
(2), (4) Date: Apr. 16, 2003

(87) PCT Pub. No.: WO01/93728

PCT Pub. Date: Dec. 13, 2001

(65) Prior Publication Data

US 2003/0150830 A1 Aug. 14, 2003

(30) Foreign Application Priority Data

Jun. 6, 2000 (GB) ..... 0013698

(51) Int. Cl.
*A47B 47/00* (2006.01)

(52) U.S. Cl. ..... 211/187; 211/88.02; 211/175; 211/192; 211/206

(58) Field of Classification Search ..... 211/187, 211/88.02, 175, 90.02, 206, 90.04, 103, 190, 211/133.1, 189, 191, 192, 123, 182, 43, 204, 211/149; 403/348, 349; 108/105, 110, 181, 108/147.11, 147.16; 312/265.5, 265.6
See application file for complete search history.

(56) References Cited

U.S. PATENT DOCUMENTS

| | | | | |
|---|---|---|---|---|
| 2,218,444 A | | 10/1940 | Vineyard | 211/49 |
| 3,351,209 A | | 11/1967 | Kofoed et al. | 211/49 |
| 3,918,591 A | * | 11/1975 | Cooper | 211/204 |
| 4,243,145 A | | 1/1981 | Woodhead | 211/49 |
| 4,500,146 A | * | 2/1985 | Peterson | 312/257.1 |
| 4,523,722 A | * | 6/1985 | Cohen et al. | 211/175 |
| 4,928,833 A | * | 5/1990 | Huizenga | 211/187 |
| 5,228,578 A | * | 7/1993 | Wu | 211/43 |
| 5,231,908 A | * | 8/1993 | Skvarce et al. | 83/699.11 |
| 5,265,740 A | * | 11/1993 | Hodsden et al. | 211/187 |
| 5,427,255 A | * | 6/1995 | Nook | 211/187 |
| 5,681,127 A | * | 10/1997 | Willen | 403/322.1 |

(Continued)

FOREIGN PATENT DOCUMENTS

DE 9114119 U 1/1992

(Continued)

OTHER PUBLICATIONS

Official Action issued Apr. 28, 2005 in corresponding Russian application No. 2002135607/12(038243), English translation attached.

(Continued)

*Primary Examiner*—Jennifer E. Novosad
(74) *Attorney, Agent, or Firm*—Myers Bigel Sibley & Sajovec, P.A.

(57) ABSTRACT

A merchandise display matrix includes at least one pair of upright members and a merchandise tray support member wherein the support member is adjustable in length. In other embodiments, a merchandise display matrix includes at least one pair of upright members and a plurality of merchandise display trays, including a first end tray and a second end tray, wherein the display trays are provided with apparatus for fixing the trays together and the first and the second end trays are provided with apparatus for engaging with the uprights.

19 Claims, 5 Drawing Sheets

U.S. PATENT DOCUMENTS

| | | | | |
|---|---|---|---|---|
| 5,865,517 | A * | 2/1999 | Wang | 312/237 |
| 5,875,919 | A | 3/1999 | Spamer et al. | 221/289 |
| 6,135,583 | A * | 10/2000 | Simon et al. | 312/257.1 |
| 6,464,090 | B1 * | 10/2002 | Martinez | 211/70.2 |

FOREIGN PATENT DOCUMENTS

| | | | |
|---|---|---|---|
| DE | 9216150 | U | 1/1993 |
| DE | 29820447 | U | 2/1999 |
| GB | 670065 | A | 4/1952 |

OTHER PUBLICATIONS

PCT Search Report dated Aug. 23, 2001 for corresponding PCT application No. PCT/GB01/02463.

* cited by examiner

DISPLAY ASSEMBLY

RELATED APPLICATION INFORMATION

This application claims the benefit under 35 U.S.C. § 371 from PCT Application No. PCT/GB01/02463, filed Jun. 5, 2001, which in turn claims priority from GB 0013698.6, filed Jun. 6, 2000, the disclosures of which are incorporated by reference herein in their entireties. The above PCT International Application was published in the English language and has International Publication No. WO 01/93728 A1.

FIELD OF THE INVENTION

This invention relates to a novel merchandise display assembly.

BACKGROUND OF THE INVENTION

Merchandising display stands conventionally comprise a plurality of merchandise trays, optionally provided with a product pusher to urge merchandise to the front of the trays, optionally provided with a product pusher to urge merchandise to the front of the tray. Conventional stands comprise either a rear plate in which one or more merchandise trays may be mounted. Alternatively, a conventional stand may comprise at least a pair of uprights with one or more merchandise trays supported there between. In such systems the merchandise trays will generally rest on or be fixed to one or more support members which span between the two uprights must be constant.

SUMMARY OF THE INVENTION

We have now found a novel merchandise display assembly which overcomes or mitigates the disadvantages of conventionally known systems and provides an assembly which can be aesthetically much more exciting.

Thus according to the invention we provide a merchandise display matrix which comprises at least one pair of stand members and a merchandise tray support member situated between the stand members characterised in that the support member is adjustable in length.

In use, the stand members are preferentially positioned in a substantially upright position.

The merchandise tray support member may comprise a single body or a plurality of members, e.g. rods, which are spaced apart so as to support one or more merchandise trays. Preferentially, the support comprises a pair of support rods.

The adjustable support rods may comprise a conventional means of adjustment. Thus for example, one portion of a support rod may be adapted to slide over another portion. In an especially preferred embodiment the support rods are telescopically adjustable, that is, a support rod may comprises to parts, one part slidably mounted within the other.

In use, once the support rods are adjusted it is necessary to fix them at the desired length.

Thus according to a further feature of the invention we provide a merchandise display matrix as hereinbefore described wherein means is provided for fixing the adjustable support member at a desired length between the stand members.

Conventionally known fixing means may be used. Thus, the means for fixing the rods at the desired length may be at or adjacent to the junction between the two support rod parts. For example, two portions of an adjustable support rod may be fixed together, e.g. by an adjustable screw clamp. Alternatively, by securing distal ends of the support rods in the stand members, the length of the support rods may be fixed, such that, once they are adjusted, they can neither expand nor contract. It is within the scope of this invention that any one or any combination of such fixing means may be used. In one embodiment the invention provides a rotatable key member situated at distal ends of the rods. Each key member is adapted to fit into a lock member provided in the stand member. Preferentially, a key member is provided at either end of the support rod and a corresponding lock member provided in each of a pair of stand members. Thus, the stand members may be provided with a plurality of lock members enabling the system to be fully adjustable and very versatile.

One preferred key and lock member arrangement comprises a rotatable disc and a corresponding slot respectively. Thus, in use, the disc, which may be mounted via its annular edge on one end of the rod, is pushed through the slot and then rotated, preventing it from being retracted back through the slot. For example, an annular surface of the disc is presented to a substantially vertical slot (although it is within the scope of this invention that the slot may be horizontal), so that the disc can mate with the slot. The disc may then be pushed through the slot and rotated so that the disc cannot be retracted through the slot. The discs preferably comprise a rigid material, e.g. a rigid plastics material or a metal.

In an alternative and preferred embodiment the slot may comprise a "keyhole" type structure. Thus, for example, the slot itself may comprise a first portion of a given diameter and a second portion of a smaller diameter. The larger diameter portion preferentially corresponds with the diameter of the disc, whilst the smaller diameter corresponds with the diameter of the rod. Preferentially, the smaller diameter portion lies vertically below the larger diameter portion. Thus, the disc is connected via its axial surface to the rod. In use, the axial surface of the disc is pushed through the slot sufficiently for the rod which is of diameter proportionate to the diameter of the smaller diameter portion of the slot, to drop into the lower portion of the slot. The radial surface of the disc can engage with the smaller diameter portion of the slot.

The support rods may comprise a rigid or a flexible material. The use of a rigid material provides greater strength and may be suitable for heavy merchandise. Alternatively, the use of a flexible material has the advantage that the rods and end discs may be placed into slots in different horizontal positions. Thus the rods may present a slope. Similarly if the rods are adjusted to a length which is slightly longer than the width between the two uprights, the rods may be bowed.

The use of adjustable support members as hereinbefore described also allow the use of upright members which may be curved such that the separation between a pair of uprights may vary along the length of the uprights.

Therefore, according to a yet further feature of the invention a pair or a plurality of pairs of upright stand members maybe housed in a carcass fame. The carcass frame may be provided with a pair of substantially horizontal plates provided with means for engaging with at least a pair of uprights. Any conventionally known engaging means may be used. However, a preferred engaging means comprises a pin member and a socket member and especially a pair of pins adapted to engage with a pair of sockets. Preferably, the pins are provided in the uprights and the sockets in the carcass frame, although it is within the scope of the invention herein described that the sockets may be in the uprights and the pins in the carcass frame. Thus, according to a further feature of the invention we provide a merchandise display matrix which comprises a pair of substantially horizontal plates provided with means for engaging at least a pair of uprights characterised in that at least one of the uprights is curved.

In a further embodiment of the invention the need for a display tray support member may be overcome by simply fixing a plurality of merchandise display trays together.

Thus in a yet further embodiment of the invention we provide a merchandise display matrix which comprises at least one pair of upright members and a plurality of merchandise display trays including a first end tray and a second end tray characterised in that the display trays are provided with means for fixing the trays together and the first and the second end trays are provided with means for engaging with the uprights.

In one embodiment the merchandise display tray includes a resilient clip. The dimensions of the clip are such that the clip may hold together at least a pair of merchandise trays.

In one embodiment the clip holds together two merchandise trays by way of the side walls of the respective trays. Thus, the clip comprises a pair of arms biased together, the width of space between the arms is less than the width of two side walls combine. The clip may attach to the merchandise tray along any part of their length. However, preferably, the clip attaches to the rear of the merchandise tray.

According to a further feature of the invention we provide a method of displaying merchandise which comprises the use of a merchandise display matrix as hereinbefore described.

We also provide a kit comprising at least one pair of stand members, an adjustable merchandise tray support member as hereinbefore described and optionally one or more merchandise display trays.

The invention will now be described by way of example only and with reference to the accompanying drawings in which;

DETAILED DESCRIPTION OF PREFERRED EMBODIMENTS

Figure 1:
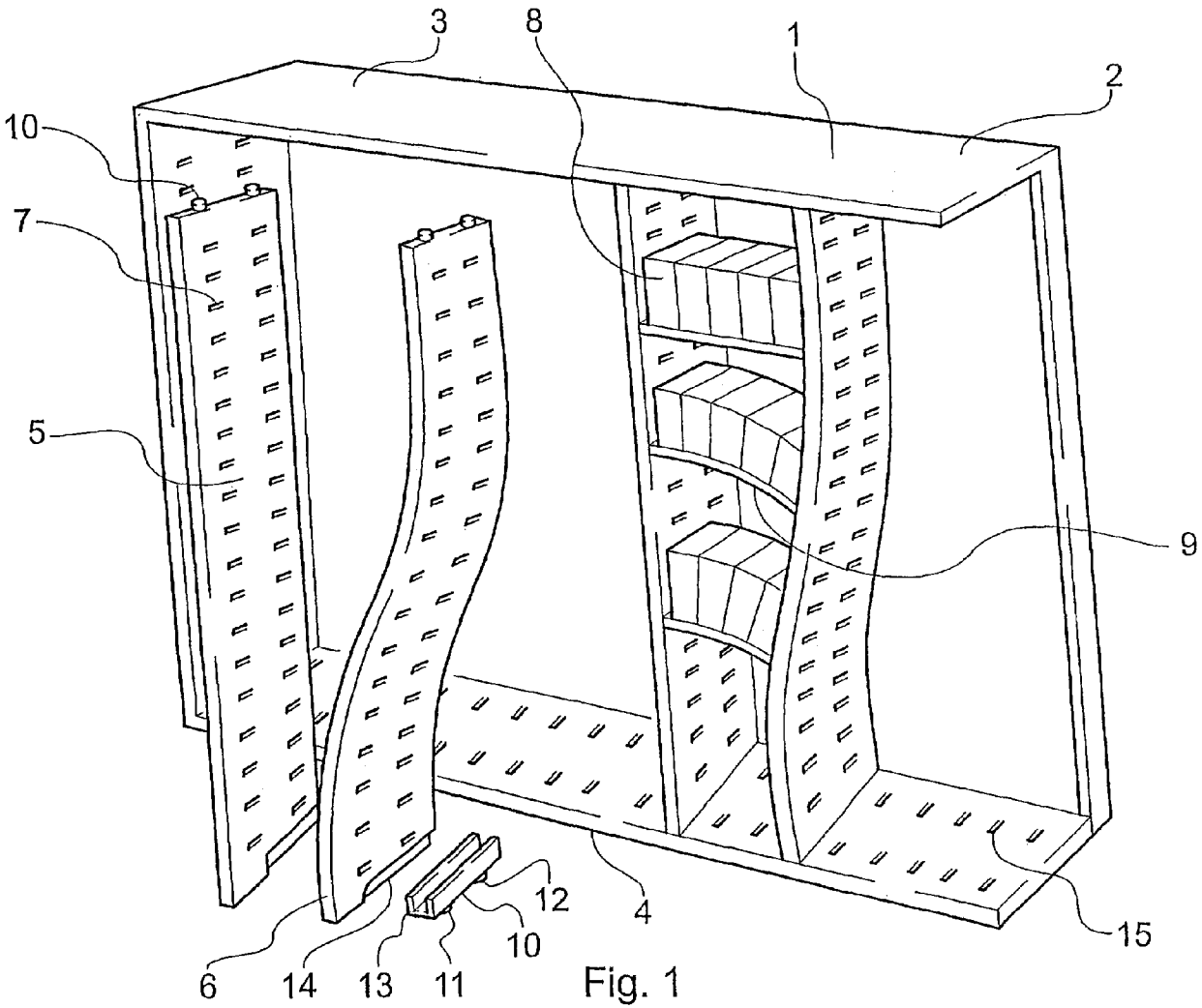
FIG. 1 is a perspective representation of a carcass frame and corresponding uprights.

With reference to FIG. 1 a merchandise display matrix (1) comprises a carcass frame (2) comprising a pair of horizontal plates (3) and (4), adapted to engage with uprights stand members (5) and (6). The stand members (5 and 6) are provided with slots (7) to engage with merchandise display trays (8) or tray supports (9). The means for engaging the uprights (5 and 6) with the horizontal plate (4) comprises a pin assembly (10) which comprises a pair of pins (11 and 12) attached to a frame (13) which can co-operate with the base (14) of the upright (6). The horizontal plate (4) is provided with a plurality of spaced apart sockets (15) adapted to engage with the pins (11 and 12).

Figure 2:
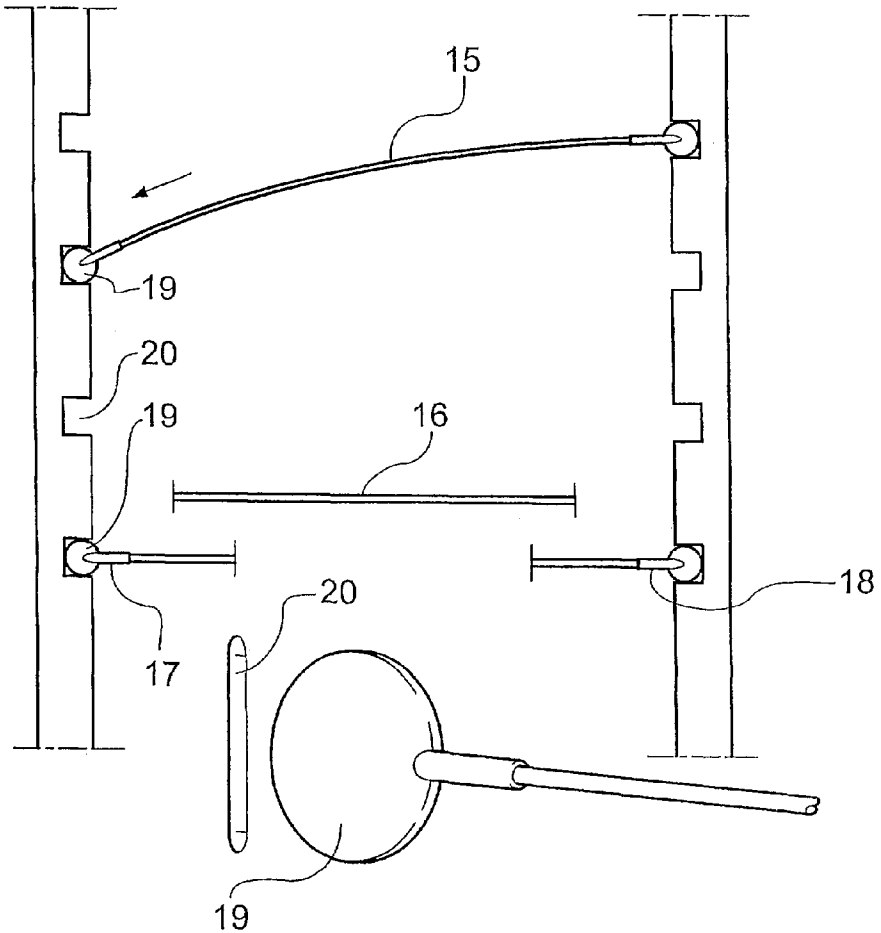
FIG. 2 is a cross-sectional representation of telescopic rods fitting into slots.
Figure 3:
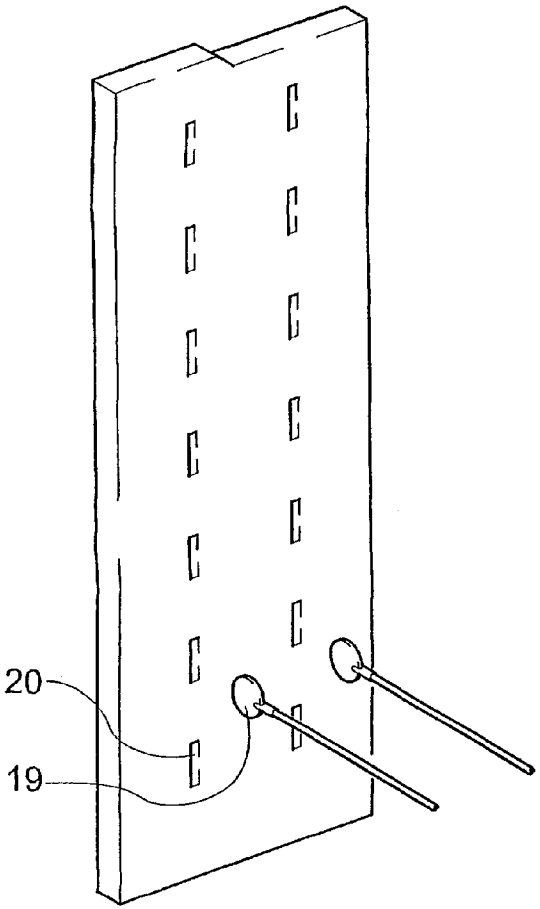
FIG. 3 is a perspective representation of telescopic bars fitting into slots.

Referring to FIGS. 2 and 3, a display support rod (15) comprises a central rod (16) provided with first and second end rods (17 and 18) which are telescopically connected to the central rod (16). Each end rod (17 and 18) is provided with a flat disc connector (19) and is connected on the annular surface (19*a*). The uprights (5 and 6) are each provided with vertical slits (20). In use the disc connector (19) is pushed into the slot (20). The rod (15) is rotated through 90°, thereby rotating the disc (19), lodging the disc in place.

Figures 4, 5:
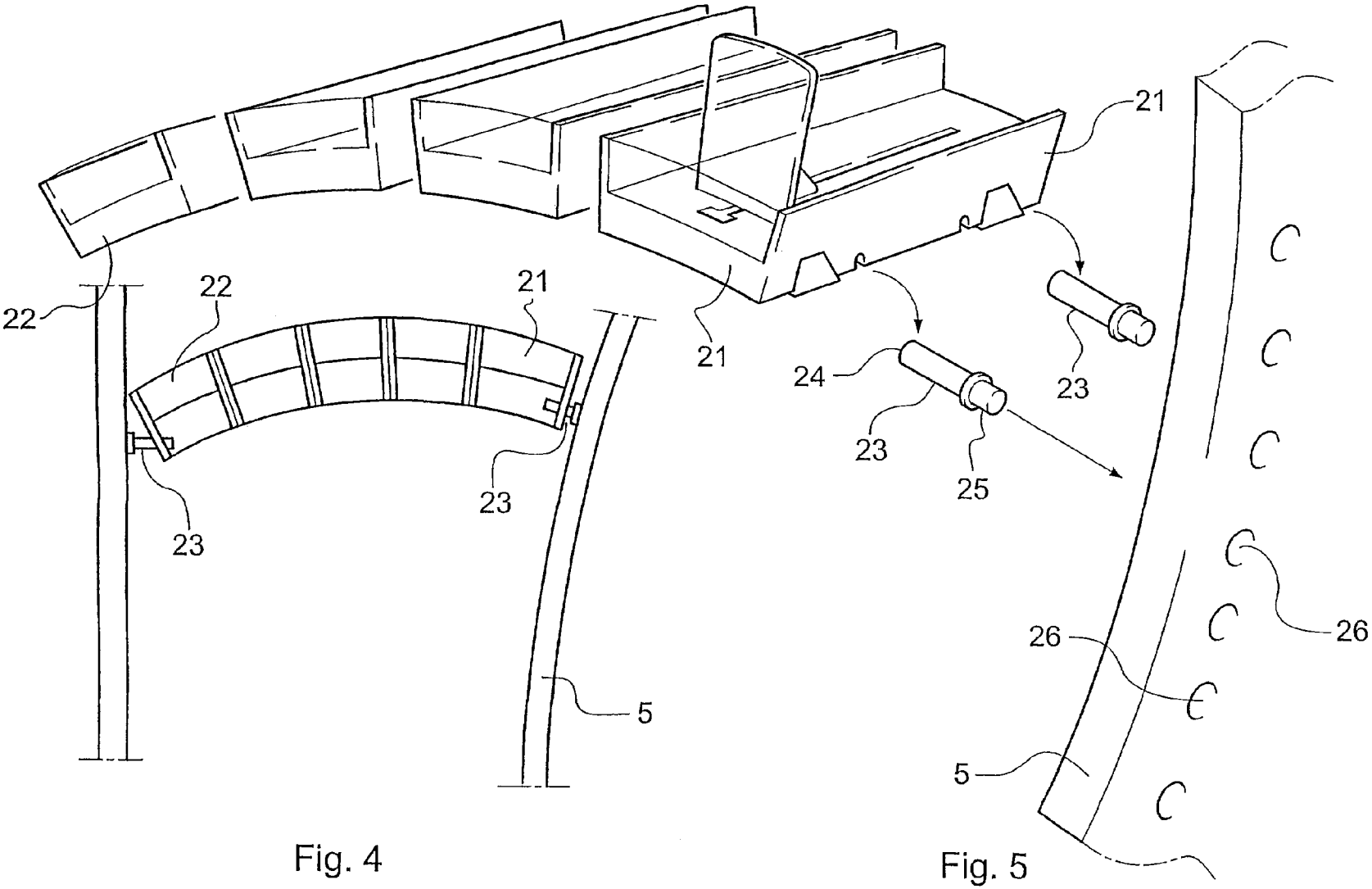
FIG. 4 is a schematic representation of display trays linked together.
FIG. 5 is a perspective view of display trays linking together and fixing to an upright.

Referring to FIGS. 4 and 5, instead of using a display tray supports (9), a plurality of display trays (9) are linked together by a connection means (not shown). End display trays (21 and 22) are provided with pins (23). A first end (24) of pin (23) supports the end display tray (21), whilst a second end (25) of pin (23) engages with apertures (26) in the upright (5).

Figure 6:
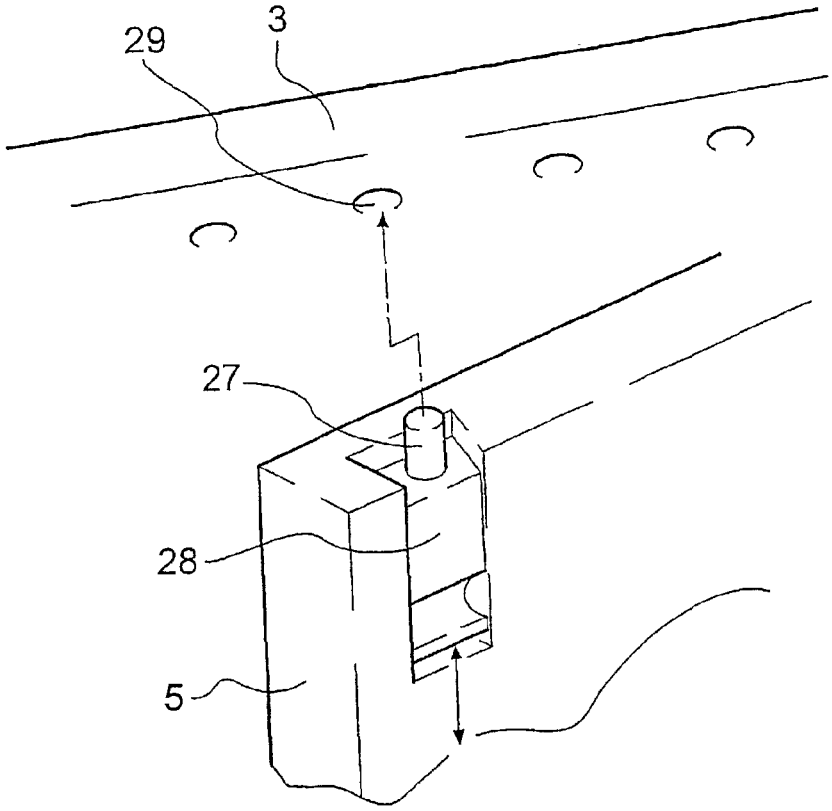
FIG. 6 is a perspective representation of a pin and socket mechanism for upright fixing.
Figure 7:
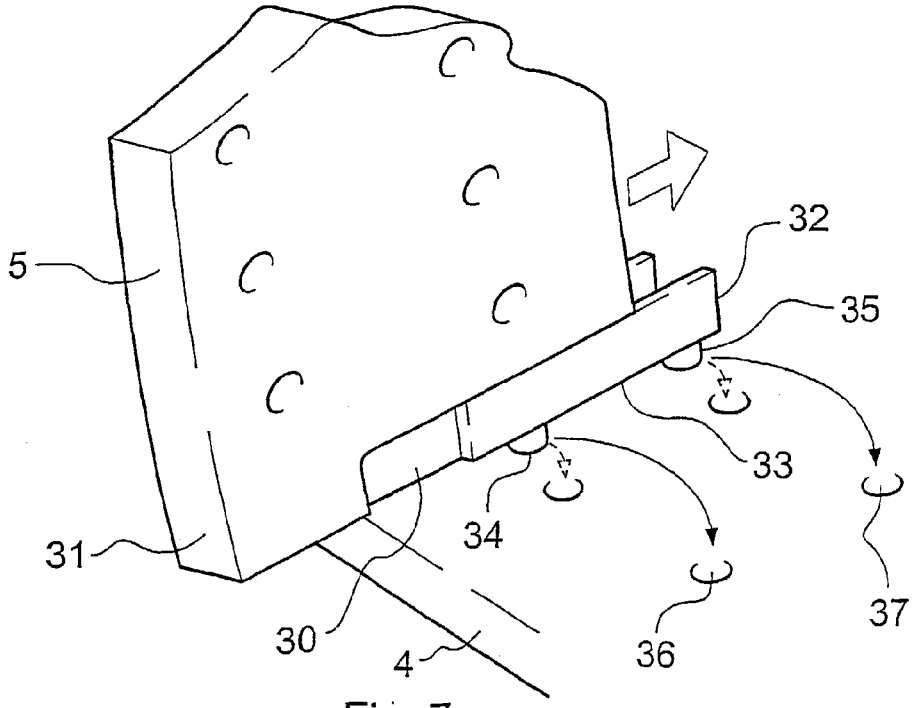
FIG. 7 is a perspective representation of an alternative pin and socket mechanism for upright fixing.

Referring to FIGS. 6 and 7, the upright (5) is located in and engaged with horizontal plates (3 and 4). With reference to FIG. 6, a pin (27) is located on block (28), the block (28) being rotatably mounted so as to be moveable from a horizontal, non-engaging position, to a vertical position in which pin (27) is located in aperture (29) of horizontal plate (3). Referring to FIG. 7, upright (5) is provided with a shoulder (30) at its lower end (31). A U-shaped bracket (32) is provided which slides over shoulder (31). The base (33) of the U-shaped bracket (32) is provided with a pair of pins (34 and 35) which are adapted to engage with apertures (36 and 37) in the horizontal base plate (4). In use, the U-shaped bracket (32) is slid into place on the upright (5) and the pins (34 and 35) located in the apertures (36 and 37). When the upright (5) is in position, block (28) is rotated and upper pin 27 is located in aperture (29) in the uppermost horizontal plate (3).

Figure 9:
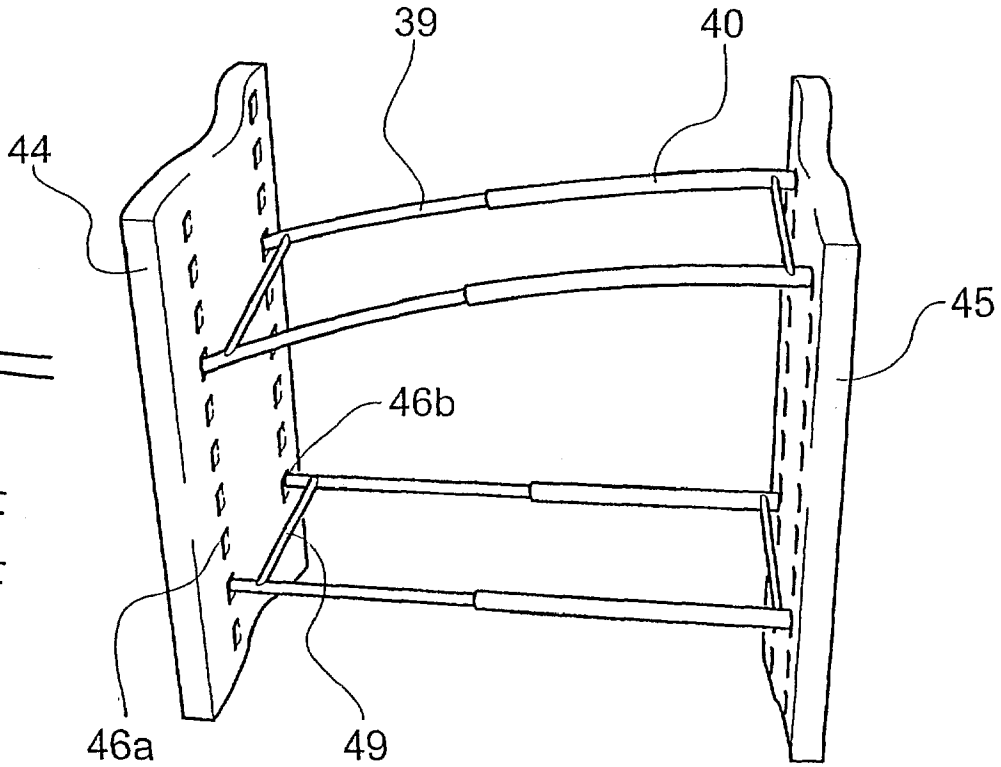
FIG. 9 is a perspective representation of telescopic bars mounted with the assembly of FIG. 8.
Figure 8:
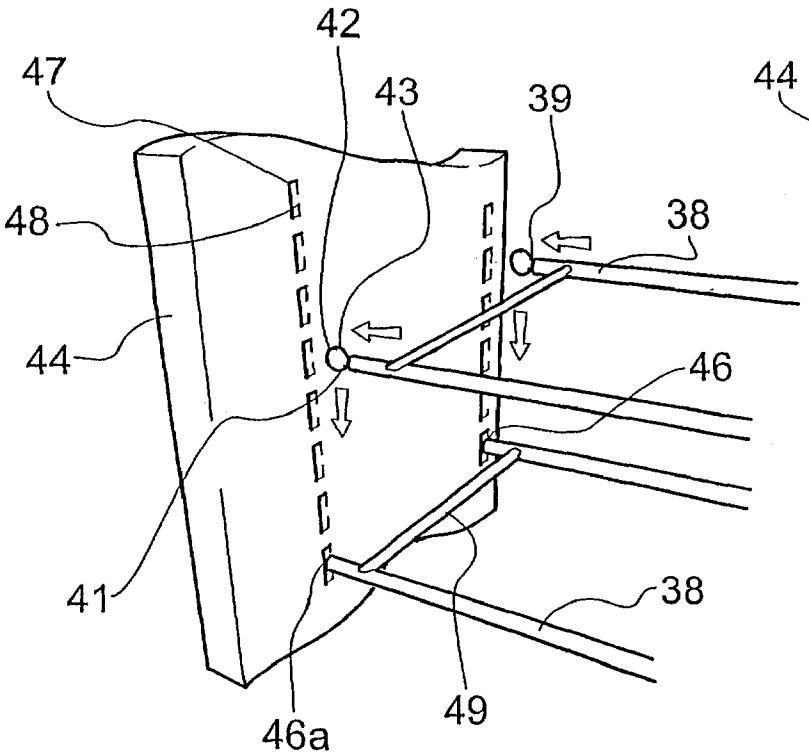
FIG. 8 is a perspective representation a radially mounted disc assembly.

Referring to FIGS. 8 and 9, a display support rod (38) comprises an inner rod (39) and an outer rod (40) which are telescopically connected to each other, such that the inner rod (39) is slidably mounted within the outer rod (40). The inner support rod (39) is connected at one end (41) with a flat disc connector (42). The disc (42) being attached to the inner rod (39) on its axial surface (43). The uprights (44 and 45) of the stand are each provided with pairs of slots (46*a* and 46*b*). Each slot (46) being of a "keyhole" shape with an upper portion (47) of a larger diameter than the lower portion (48).

A corresponding disc and slot arrangement is provided (not shown) at the end of the outer rod, distal to the junction with the inner rod.

The two support members are optionally provided with a cross bar (49).

The invention claimed is:

1. A merchandise display matrix which comprises:

at least one pair of stand members;

at least one merchandise tray support member that is adjustable in length; and means for fixing the at least one merchandise tray support member in a non-adjustable position between the at least one pair of stand members;

wherein the at least one merchandise tray support member comprises a pair of support rods and wherein the means for fixing the at least one merchandise tray comprises a key member situated at at least one end of each of the support rods, which is adapted to fit into a keyhole member provided in the corresponding stand member.

2. A merchandise display matrix according to claim 1 wherein the support rods are telescopically adjustable.

3. A merchandise display matrix according to claim 2 wherein the support rods are fixed at either end to the corresponding stand member.

4. A merchandise display matrix according to claim 1 wherein the key members are provided at either end of the support rods and the corresponding keyhole members are respectively provided in the at least one pair of stand members.

5. A merchandise display matrix according to claim 1 wherein the key member comprises a disc and the keyhole member comprises a corresponding slot.

6. A merchandise display system according to claim 5 wherein the disc is attached to the rod via an annular surface of the disc.

7. A merchandise display system according to claim 6 wherein the keyhole member comprises a slot with an upper portion of larger diameter than a lower portion.

8. A merchandise display system according to claim 7 wherein the disc is attached to the rod via an axial facing surface.

9. A merchandise display matrix according to claim 5 wherein the disc comprises a rigid material.

10. A merchandise display matrix according to claim 9 wherein the rigid material is a metal.

11. A merchandise display matrix according to claim 1 wherein the support rods comprise a flexible material.

12. A merchandise display matrix according to claim 1 wherein at least one of the at least one pair of stand members is curved.

13. A merchandise display matrix according to claim 1 which comprises at least a pair of stand members housed in a carcass frame.

14. A merchandise display matrix according to claim 13 wherein the carcass frame comprises a pair of substantially horizontal plates comprising means for engaging with the at least a pair of stand members.

15. A merchandise display matrix according to claim 14 wherein the means for engaging comprises a pin member and a socket member.

16. A merchandise display matrix according to claim 15 wherein the means for engaging comprises a pair of pins adapted to engage with a pair of sockets.

17. A merchandise display matrix according to claim 15 wherein a pair of pin members are provided in the stand members and socket members in the carcass frame.

18. A merchandise display matrix according to claim 1 which comprises a pair of substantially horizontal plates comprising means for engaging at least a pair of uprights wherein one of the uprights is curved.

19. A method of displaying merchandise comprising using the merchandise display matrix of claim 1 to display merchandise.

* * * * *